US005177554A

United States Patent [19]

Oda et al.

[11] Patent Number: 5,177,554

[45] Date of Patent: Jan. 5, 1993

[54] IMAGE FORMING APPARATUS FOR SUPERPOSING A PLURALITY OF IMAGES ON ONE TRANSFER MEDIUM

[75] Inventors: Goro Oda, Sagamihara; Hiroshi Yamane, Ebina; Masuro Tokura, Narashino, all of Japan

[73] Assignee: Kabushiki Kaisha Toshiba, Kawasaki, Japan

[21] Appl. No.: 712,522

[22] Filed: Jun. 10, 1991

[30] Foreign Application Priority Data

Jun. 13, 1990 [JP] Japan ..... 2-152551

[51] Int. Cl.[5] ..... G03G 15/01

[52] U.S. Cl. ..... 355/326; 355/288; 355/327; 165/89

[58] Field of Search ..... 118/645; 355/288, 326, 355/327, 245, 282, 385, 211; 165/89

[56] References Cited

U.S. PATENT DOCUMENTS 4,531,828 7/1985 Hoshino ..... 355/327 X
4,796,050 1/1989 Furuta et al. ..... 355/327 X
4,862,225 8/1989 Heiller et al. ..... 355/288
4,984,024 1/1991 Ohkaji et al. ..... 355/273
4,992,923 2/1991 Mitsuya et al. ..... 355/288 X
5,014,090 5/1991 Santilli ..... 355/256
5,073,796 12/1991 Suzuki et al. ..... 355/215

*Primary Examiner*—A. T. Grimley
*Assistant Examiner*—P. J. Stanzione
*Attorney, Agent, or Firm*—Foley & Lardner

[57] ABSTRACT

In an image forming apparatus according to the present invention, a plurality of image forming process units are aligned to face a horizontal transportation section of a paper transportation path. A transfer belt unit is provided to successfully transfer images formed on photoreceptor drums of the process units to a transfer medium. A flashlight device is interposed between each two adjacent process units. Developing agent images formed by means of the process units and transferred to the transfer medium are fixed to the medium by means of the flashlight devices. By doing this, a developing agent transferred to the transfer medium by means of a preceding process unit is fixed to the medium by means of its corresponding flashlight device. Thus, in an image forming process using a subsequent process unit, images can be securely superposed without causing the previously transferred developing agent to separate from the transfer medium.

9 Claims, 6 Drawing Sheets

IMAGE FORMING APPARATUS FOR SUPERPOSING A PLURALITY OF IMAGES ON ONE TRANSFER MEDIUM

BACKGROUND OF THE INVENTION

1. Field of the Invention

The present invention relates to an image forming apparatus such as a color printer, and more particularly, to an image forming apparatus which can form an image by superposing a plurality of images on one transfer medium.

2. Description of the Related Art

A practical example of the image forming apparatus of this type is disclosed in Published Unexamined Japanese Patent Application No. 64-28665.

In this apparatus, a charging means, an exposure means, a developing means for developing agents (toners) of four colors, yellow, magenta, cyan, and black, a transfer drum, and a cleaning means are arranged so that each faces a one photoreceptor. As the photoreceptor makes one revolution, an image of one color is formed on the photoreceptor and transferred to a transfer medium, which is wound on the transfer drum. As the photoreceptor and the transfer drum make four revolutions, images of four colors are superposed on one and the same transfer medium.

Thus, in the conventional multi-color image forming apparatus, the images of four colors cannot be superposed on the same transfer medium unless the medium wound on the transfer drum is caused to make four revolutions, so that high-speed processing cannot be effected.

Thereupon, apparatuses capable of high-speed multicolor image forming have been proposed, such as disclosed in Published Unexamined Japanese Patent Applications Nos. 64-40847, 64-44457, and 64-49062.

In these apparatuses, a plurality of image forming means for forming images of different colors on an image carrier are successively arranged facing a transportation path for a transfer medium. A multi-color image can be formed as the transfer medium is transported past the individual image forming means.

According to these prior art apparatuses, however, a plurality of colors are simply superposed in succession by transporting the transfer medium past the individual image forming means. Therefore, the developing agent transferred to the transfer medium by means of a preceding image forming means is electrically charged and changes its polarity, due to the influence of corona discharge in a transfer process using a subsequent image forming means. In the transfer process using the subsequent image forming means, the developing agent transferred to the transfer medium by means of the preceding image forming means is separated from the medium and scatters, so that satisfactory images cannot be formed. This constitutes a hindrance to the practical use of the proposed apparatuses.

Thus, there have conventionally been high-speed image forming apparatuses in which a plurality of image forming means for forming images of different colors on an image carrier are successively arranged facing a transportation path for a transfer medium. A multicolor image can be formed as the transfer medium is transported past the individual image forming means. In a transfer process using a subsequent image forming means, however, a developing agent transferred to the transfer medium by means of a preceding image forming means is separated from the medium, so that the proposed apparatuses cannot be put to practical use.

SUMMARY OF THE INVENTION

Accordingly, the object of the present invention is to provide an image forming apparatus capable of quickly obtaining a multiplex image as a transfer medium is transported past a plurality of image forming means, in which a developing agent transferred to the transfer medium by means of a preceding image forming means can be securely prevented from separation from the medium in an image forming process using a subsequent image forming means, so that a satisfactory image can be formed at high speed.

According to the present invention, there is provided an image forming apparatus which comprises:

first forming means for forming a first color image on a first image carrier;

first transfer means for transferring the first color image formed by the first forming means to a transfer medium;

second image forming means for forming a second color image on a second image carrier;

second transfer means for transferring the second color image formed by the second forming means to the transfer medium;

means for conveying the transfer medium to the first transfer means and the second transfer means; and means, located between the first transfer means and the second transfer means, for fixing the first color image transferred by the first transfer means to the transfer medium so as not to separate first color image from the transfer medium when the second transfer means transfers the second color image to the transfer medium.

According to the image forming apparatus of the present invention, a developing agent transferred to the transfer medium by means of a preceding image forming means is fixed to the medium by means of the fixing means. Thus, in an image forming process using a subsequent image forming means, very satisfactory images can be obtained without causing the transferred developing agent to be separated from the transfer medium.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention and, together with the general description given above and the detailed description of the preferred embodiment given below, explain the principles of the invention.

DETAILED DESCRIPTION OF THE PREFERRED EMBODIMENTS

An embodiment of the present invention will now be described in detail with reference to the accompanying drawings.

Figure 1:
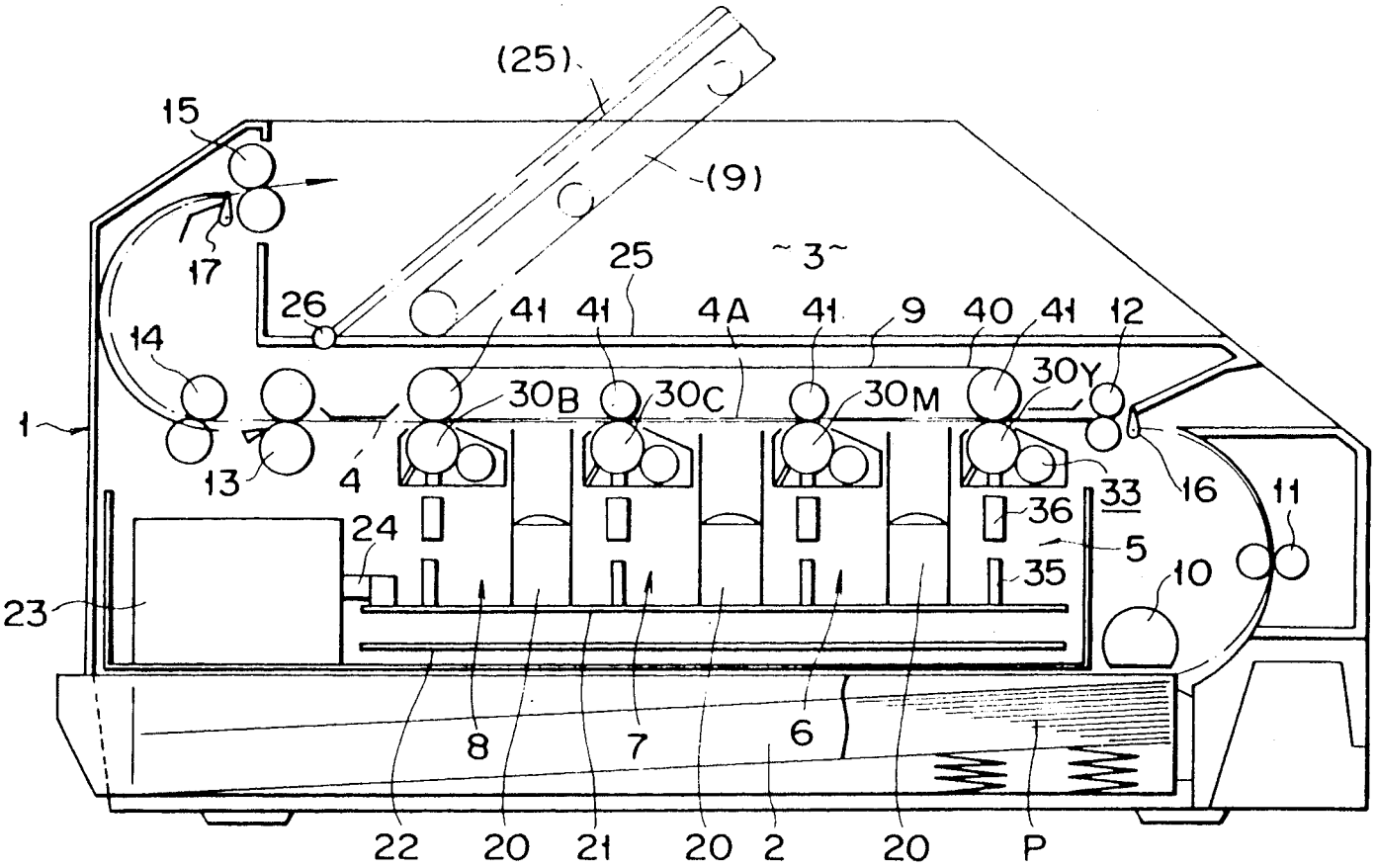
FIG. 1 is a schematic view showing an arrangement of an image forming process unit and its surroundings.

FIG. 1 shows an internal mechanism of a high-speed compact color printer as an image forming apparatus. A paper cassette 2 is inserted in the bottom portion of a apparatus shell 1. A paper receiving section 3 is defined in the form of a recess in the top face of the shell 1.

An S-shaped transportation path 4, for use as transportation means, is formed in the apparatus shell 1. The path 4 serves to guide a transfer medium or paper sheet P, delivered from the paper cassette 2, to the paper receiving section 3.

Further, the apparatus shell 1 contains yellow, magenta, yellow and black process units 5, 6, 7 and 8 for uses as first, second, third, and fourth image forming means, respectively. These units are successively arranged in the paper feeding direction so as to face the underside of a horizontal transportation section 4A, which is situated in the middle of the paper transportation path 4.

A transfer belt unit 9 for use as transfer means is disposed on the top side of the horizontal transportation section 4A of the paper transportation path 4, to face the process units 5 to 8.

A paper supply roller 10 for use as paper supply means, a feed roller pair 11, and an aligning roller pair 12 are arranged in succession on the upper-course side of the paper transportation path 4. A fixing unit 13 for use as fixing means, a feed roller pair 14, and an exit roller pair 15 for use as paper discharge means are arranged on the lower-course side of the path 4. An aligning switch 16 and an exit switch 17 are disposed beside the aligning roller pair 12 and the exit roller pair 15, respectively.

Flash light devices 20 for use as tentative fixing means are disposed individually between the yellow and magenta process units 5 and 6, between the magenta and cyan process units 6 and 7, and between the cyan and black process units 7 and 8.

Developing agent or toner images formed by means of the yellow, magenta, and cyan process units 5, 6 and 7 are tentatively fixed by means of the flashlight devices 20 which are situated just behind their corresponding process units.

In this tentative fixing, a developing agent (toner) T is fixed at least firm enough not to be separated from the paper sheet P in the next process for transfer.

An engine controller 21 for controlling a drive system for the internal mechanism is located under the process units 5 to 8 and the flashlight devices 20. A multi-color controller for color control 22 underlies the controller 21.

A transformer 23, which is disposed in the apparatus shell 1, is connected to the engine controller 21 by means of a connector 24 for use as connecting means.

The bottom surface portion of the paper receiving section 3 of the apparatus shell 1 is composed of a receiving tray 25 which doubles as a top cover of the shell 1. The transfer belt unit 9 is integrally built under the tray 25. If necessary, the tray 25 can be lifted or swung up around a shaft 26, as indicated by the two-dot chain line.

Figure 2:
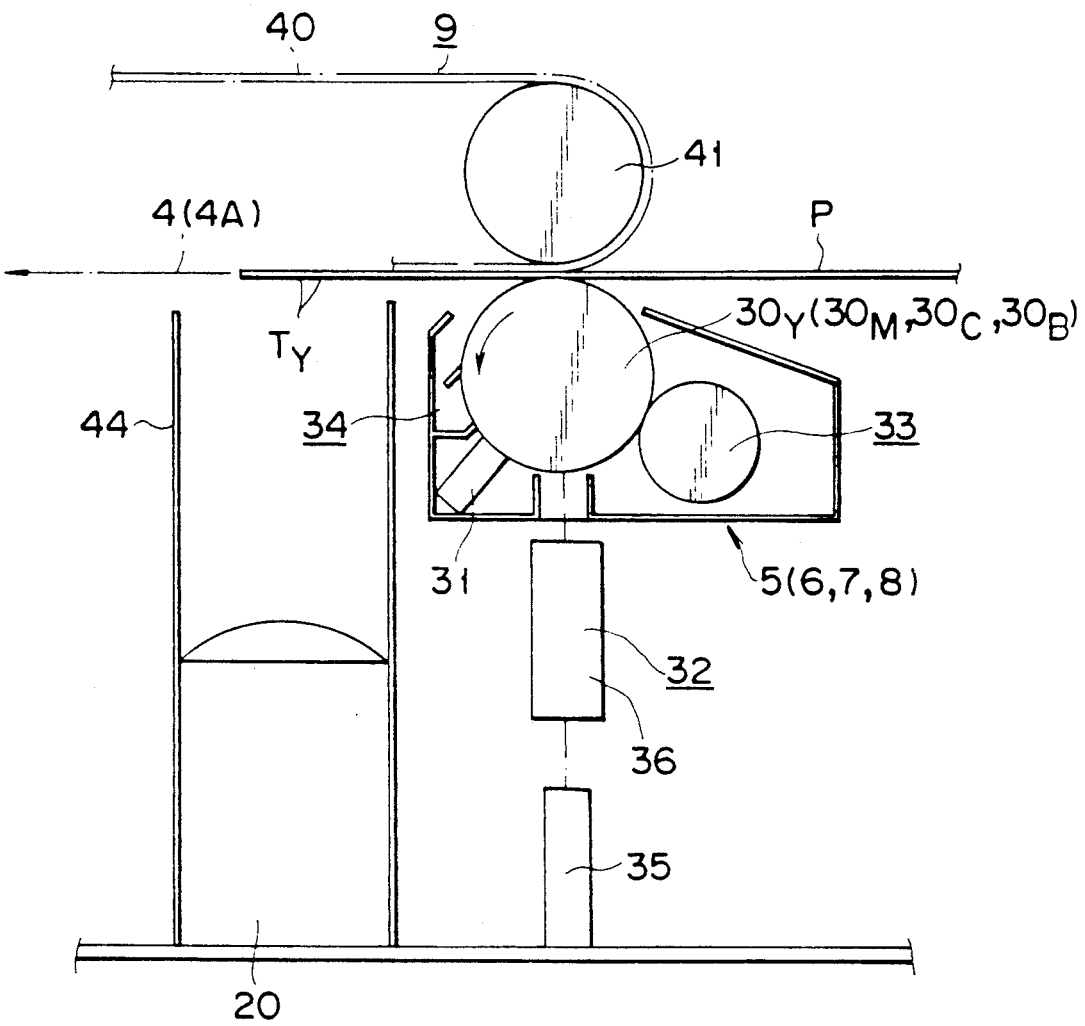
FIG. 2 is a schematic view showing an internal mechanism of a high-speed compact printer.

The yellow process unit 5, for use as the first image forming means, is constructed in the manner shown in FIG. 2.

More specifically, the process unit 5 comprises a photoreceptor drum $30_Y$ for use as an image carrier, which is opposed to the paper transportation path 4. The drum $30_Y$ is rotated in the direction of arrow L by means of a drive mechanism (not shown).

Image forming process means, that is, a main charger 31 for use as charging means, electrostatic latent image forming means 32, a developing unit 33 for use as developing means, a cleaner unit 34 for use as cleaning means, and an de-electrifier (not shown), are successively arranged around the photoreceptor drum $30_Y$ in the rotating direction thereof.

The latent image forming means 32 is formed of a luminous array 35 for use as light emitting means and a convergent light transmitting element (Selfoc lens array, trademark) 36.

Since the other process units 6 to 8 are constructed in the same manner as the yellow process unit 5, a detailed description of their construction is omitted.

The transfer belt unit 9 is formed of a transfer belt 40 and a plurality of biased rollers 41 arranged inside the belt 40 so as to face the photoreceptor drums $30_Y$, $30_M$, $30_C$ and $30_B$, individually.

Each flashlight device 20 is provided with a guide 44 so that it can irradiate only a predetermined region. The developing agent or toner images $T_Y \ldots$, $T_M \ldots$, $T_C \ldots$ and $T_B \ldots$, transferred to the surface of the paper sheet P, are melted and tentatively fixed.

Figure 3:
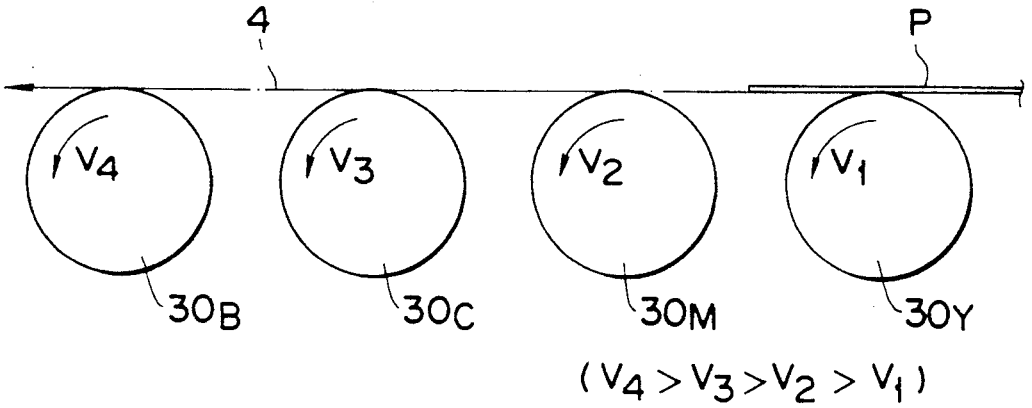
FIG. 3 is a diagram illustrating the relationships between the respective peripheral speeds of photoreceptor drums.

As shown in FIG. 3, the respective peripheral speeds V1, V2, V3 and V4 of the photoreceptor drums $30_Y$, $30_M$, $30_C$ and $30_B$ of the process units 5, 6, 7 and 8 have relationships given by $V4>V3>V2>V1$, that is, the speed increases downstream with respect to the paper feeding direction. Thus, the paper sheet P being transported along the paper transportation path 4 can be prevented from slackening. Also, imaging errors can be prevented by securely superposing the toner images $T_Y \ldots$, $T_M \ldots$, $T_C \ldots$ and $T_B \ldots$ on the sheet P without any deviation.

The relationships $V1<V2<V3<V4$ between the respective peripheral speeds of the photoreceptor drums $30_Y$, $30_M$, $30_C$ and $30_B$ are based on small differences in speed proportional to differences in diameter between the drums having substantially the same shape, and not on the gear ratio of the drive system, or the like. Thus, the stability of the image quality and productivity can be ensured.

The differences in diameter between the photoreceptor drums $30_Y$, $30_M$, $30_C$ and $30_B$ are set so as to vary within a range of allowance of about 0.6%. For example, about 1 mm is allowed for size-A4 paper P.

Figure 4:
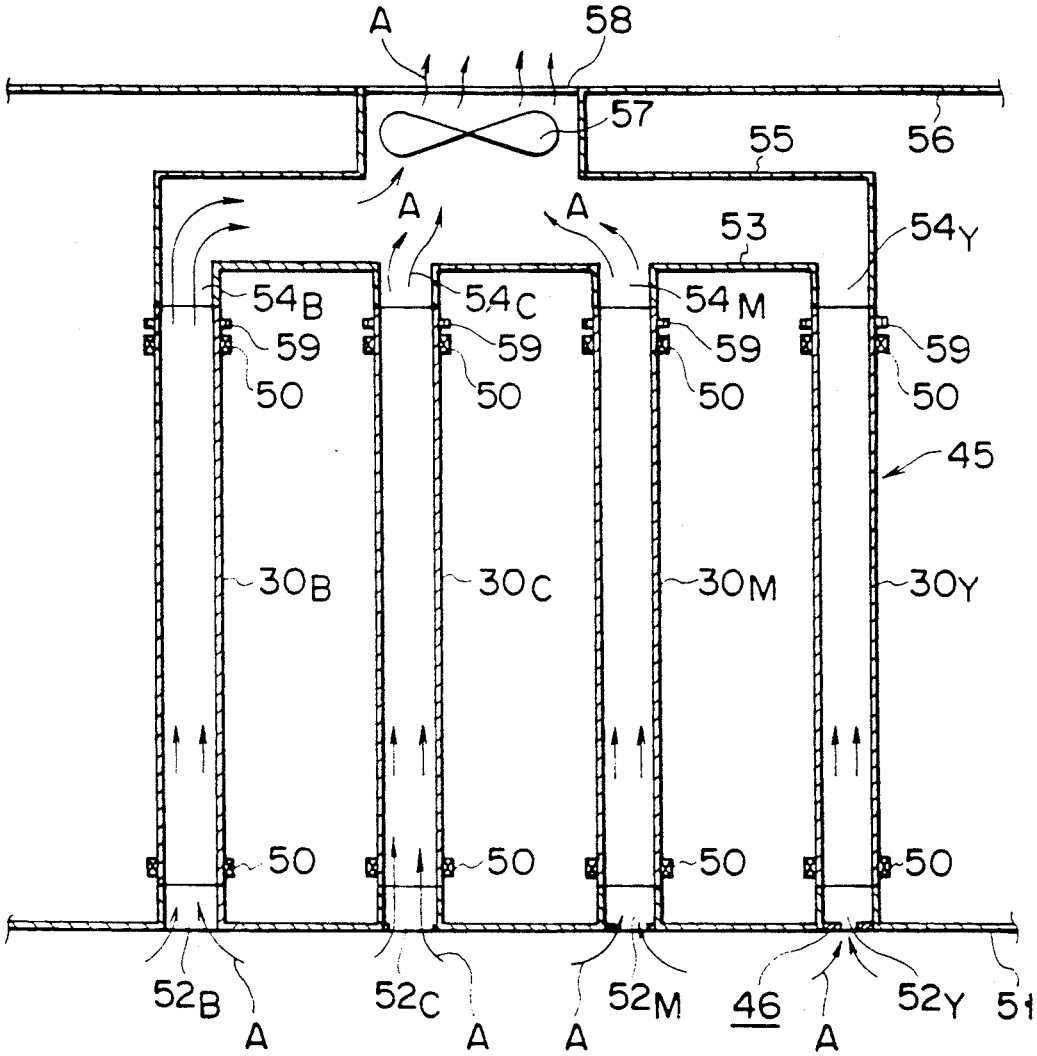
FIG. 4 is a schematic cross-sectional plan view showing an arrangement of a cooling means for the photoreceptor drums.

The photoreceptor drums $30_Y$, $30_M$, $30_C$ and $30_B$ are compulsorily air-cooled by means of air current generating means 45 for use as cooling means shown in FIG. 4.

The air current generating means 45 includes an exhaust fan 57 for use as blast means for producing a current of air, a duct 55 through which the air current (hereinafter referred to as cooling air) A produced by means of the fan 57 is introduced into the photoreceptor drums $30_Y$, $30_M$, $30_C$ and $30_B$, and regulating means 46 for regulating the amount of the cooling air A delivered to each drum through the duct 55.

Each of the photoreceptor drums $30_Y$, $30_M$, $30_C$ and $30_B$ is a hollow structure which is rotatably supported by means of a pair of bearings 50. One end opening each of the photoreceptor drums $30_Y$, $30_M$, $30_C$ and $30_B$ face air inlet ports $52_Y$, $52_M$, $52_C$ and $52_B$ for use as air passages in a front frame 51, respectively, while the other end openings face air outlet ports $54_Y$, $54_M$, $54_C$ and $54_B$ for use as air passage sections in a frame 53.

The air outlet ports $54_Y$, $54_M$, $54_C$ and $54_B$ communicate with the duct 55, and air is discharged to the outside through a exhaust port 58 which is provided with the exhaust fan 57 for use as the blast means attached to a rear frame 56.

As the exhaust fan 57 rotates, the cooling air A is introduced into the photoreceptor drums $30_Y$, $30_M$, $30_C$ and $30_B$, thereby compulsorily cooling the same from the inside. Thus, the drums, heated under the influence of the tentative fixing by means of the flashlight devices 20, can be compulsorily air-cooled to be kept at a fixed temperature, so that they can maintain reliable properties.

Since the cooling air A flows through the respective hollows of the photoreceptor drums $30_Y$, $30_M$, $30_C$ and $30_B$ without leaking to the outside, moreover, bad influences on the formed images, such as defective transfer due to scattering of toner particles, vibration of the paper sheet P, etc., can be prevented.

Although the amount of heat produced by each flashlight device 20 is substantially constant, the accumulated amount of heat applied to the paper sheet P increases as the sheet P runs downstream with respect to its feeding direction, since the sheet P is fed to a subsequent stage without being cooled to its original state. Accordingly, the temperature of each photoreceptor drum is higher than that of the one on the upper-course side thereof, with respect to the paper feeding direction. More specifically, the temperatures of the magenta, cyan, and black photoreceptor drums $30_M$, $30_C$ and $30_B$ are higher than those of the yellow, magenta, and cyan photoreceptor drums $30_Y$, $30_M$ and $30_C$, respectively.

In order to prevent the above tendency, thereby maintaining the specific properties of the photoreceptor drums $30_Y$, $30_M$, $30_C$ and $30_B$, the amount of cooling air for each drum can be made greater than that for the drum on the upper-course side thereof, with respect to the paper feeding direction, by means of the regulating means 46.

More specifically, the regulating means 46 is designed so that there are relationships $D1 < D2 \leqq D3 \leqq D4$ where D1, D2, D3 and D4 are the cooling air amounts for the photoreceptor drums $30_Y$, $30_M$, $30_C$ and $30_B$, respectively. In this case, the air inlet ports $52_Y$, $52_M$, $52_C$ and $52_B$ have diameters such that each one is greater in diameter than its preceding one.

Thus, the photoreceptor drums $30_Y$, $30_M$, $30_C$ and $30_B$ can ensure stable image forming without the influence of a heating by means of the flashlight devices 20.

Each of the photoreceptor drums $30_Y$, $30_M$, $30_C$ and $30_B$ is formed integrally with a gear 59, which is in mesh with a driving gear (not shown) in the apparatus shell 1 for the transmission of driving force.

Figure 5:
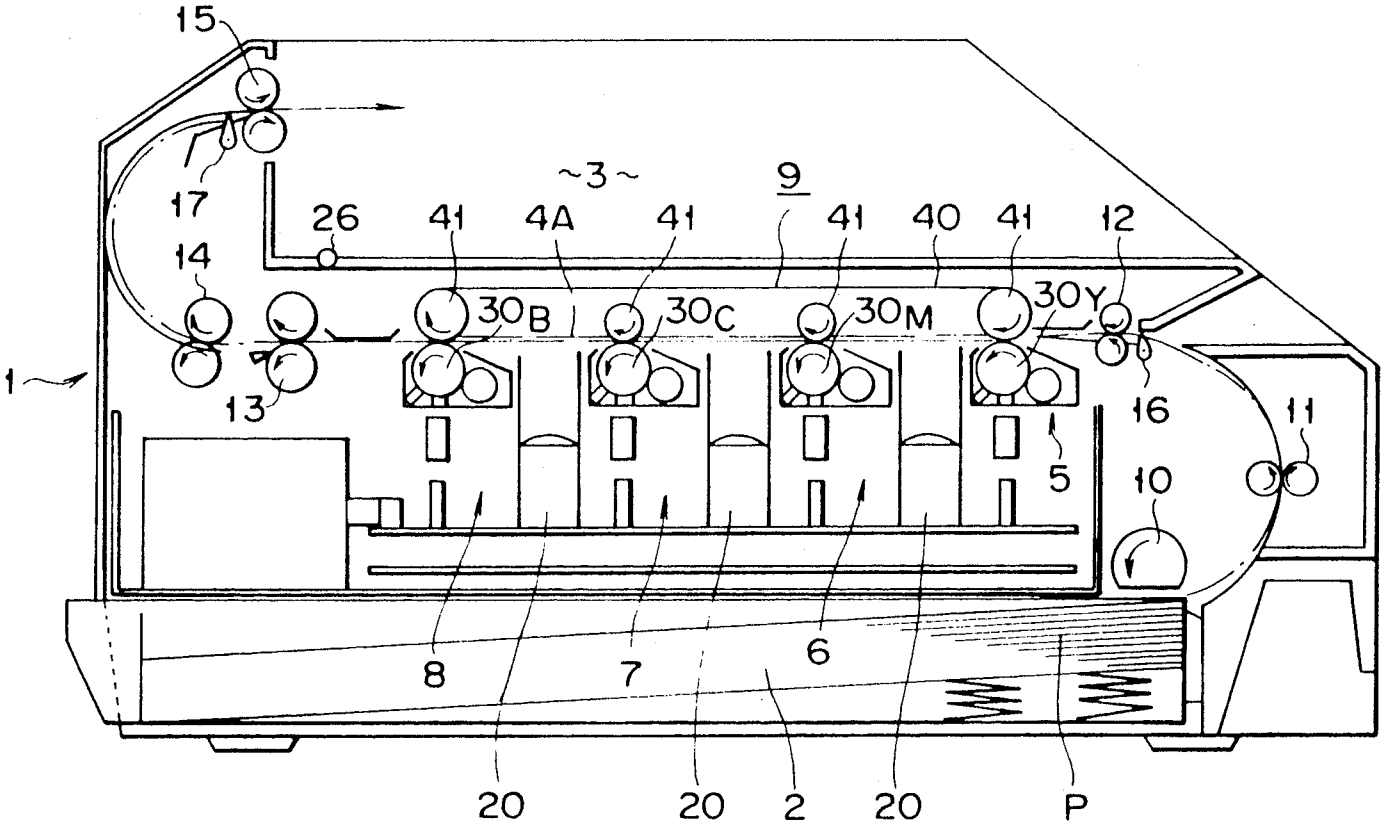
FIG. 5 is a diagram showing a flow of paper during an image forming operation.
Figure 6:
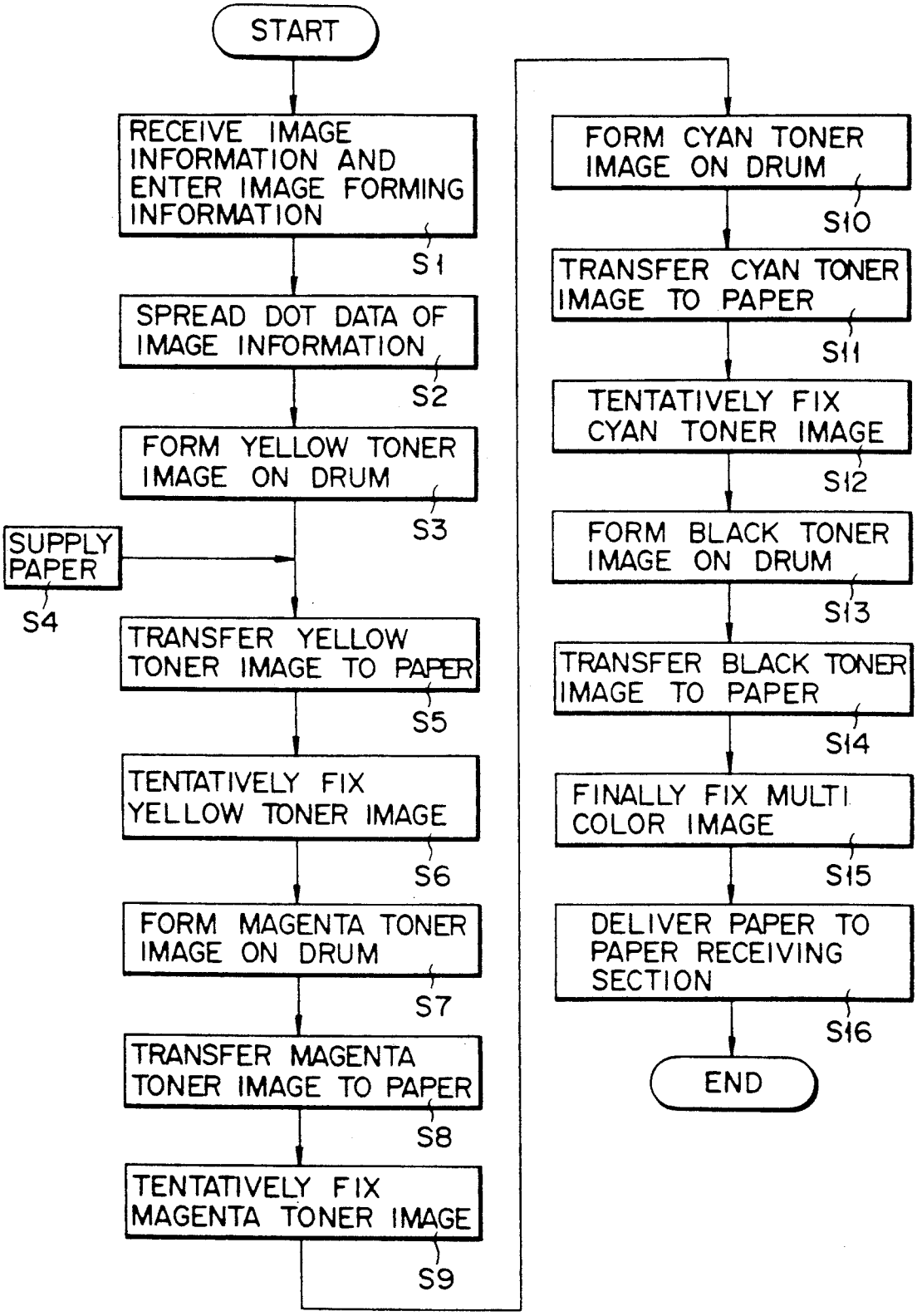
FIG. 6 is a flow chart illustrating processes of the image forming operation.

Referring now to FIGS. 5 and 6, a color image forming operation will be described.

First, image information is received, and necessary information (e.g., the number of products of image forming) for image forming is inputted (Step 1). Then, dot data of the image information is spread (Step 2).

By doing this, the yellow process unit 5 is first allowed to operate, so that an image (hereinafter referred to as yellow toner image) $T_Y$ of a yellow developing agent (yellow toner) is formed on the photoreceptor drum $30_Y$ according to conventional imaging processes, including charging, exposure, and developing (Step 3).

In synchronism with this image forming operation, the paper sheet P, which is previously taken out from the paper cassette 2 and whose leading end is aligned by means of the aligning roller pair 12, is transported to the left of FIG. 5 to be fed into an image transfer section between the photoreceptor drum $30_Y$ and the transfer belt 40 (Step 4).

The yellow toner image $T_Y$ on the photoreceptor drum $30_Y$ is electrostatically transferred to the paper sheet P by means of the bias applied to its corresponding roller 41 on the back side of the transfer belt 40 (Step 5).

Subsequently, the yellow toner image $T_Y$ is tentatively fixed on the paper sheet P by means of its corresponding flashlight device 20 (Step 6) before the sheet P is delivered to the magenta process unit 6 through the paper transportation path 4.

Thereafter, the paper sheet P is delivered to the magenta process unit 6 through the paper transportation path 4, whereupon a magenta toner image $T_M$ is formed on the photoreceptor drum $30_M$ in the same manner as aforesaid (Step 7). Then, the toner image $T_M$ on the drum $30_M$ is electrostatically transferred to the sheet P (Step 8).

Subsequently, the magenta toner image $T_M$ is tentatively fixed on the paper sheet P by means of its corresponding flashlight device 20 (Step 9) before the sheet P is delivered to the cyan process unit 7 through the paper transportation path 4.

Thereafter, the paper sheet P is delivered to the cyan process unit 7 through the paper transportation path 4, whereupon a cyan toner image $T_C$ is formed on the photoreceptor drum $30_C$ in the same manner as aforesaid (Step 10). Then, the toner image $T_C$ on the drum $30_C$ is electrostatically transferred to the sheet P (Step 11).

Subsequently, the cyan toner image $T_C$ is tentatively fixed on the paper sheet P by means of its corresponding flashlight device 20 (Step 12) before the sheet P is delivered to the black process unit 8 through the paper transportation path 4.

Thereafter, the paper sheet P is delivered to the black process unit 8 through the paper transportation path 4, whereupon a black toner image $T_B$ is formed on the photoreceptor drum $30_B$ in the same manner as aforesaid (Step 13). Then, the toner image $T_B$ on the drum $30_B$ is electrostatically transferred to the sheet P (Step 14).

As the paper sheet P is transported in this manner along the horizontal section 4A of the paper transportation path 4, the yellow, magenta, cyan, and black toner images $T_Y$, $T_M$, $T_C$ and $T_B$ are superposed on the sheet P, thus forming a multi-color image.

Then, the paper sheet P, having the multi-color image thereon, is opposed to the fixing unit 13, whereby the toner images $T_Y$, $T_M$, $T_C$ and $T_B$ are collectively melted and finally fixed to the sheet P with stability (Step 15).

Thereafter, the sheet P is discharged to the paper receiving section 3 via the exit roller pair 15 (Step 16).

After the yellow, magenta, cyan, and black toner images $T_Y$, $T_M$, $T_C$ and $T_B$ are transferred to the surface of the paper sheet P, the residual toner particles on the photoreceptor drums $30_Y$, $30_M$, $30_C$ and $30_B$ are scraped off by means of a cleaning blade of the cleaner unit 34. Thereafter, residual images on the respective surfaces of the drums $30_Y$, $30_M$, $30_C$ and $30_B$ are erased by means of de-electrifying light from the de-electrifier (not shown), whereupon the initial state is restored, that is, the image forming operation is completed.

In the process of transporting the paper sheet P from the paper cassette 2 to the paper receiving section 3, as indicated by the full-line arrow of FIG. 5, in the apparatus according to the present invention, the multi-color image can be formed at high speed as the sheet P is transported past the individual image process units 5 to 8. Thus, the image forming speed can be made much higher than in the conventional case where the image carrier is caused to make a plurality of revolutions.

Further, the flashlight devices 20 for use as the tentative fixing means are provided individually between the first and second photoreceptor drums $30_Y$ and $30_M$, between the second and third photoreceptor drums $30_M$ and $30_C$, and between the third and fourth photoreceptor drums $30_C$ and $30_B$, so that the images transferred to the paper sheet P can be tentatively fixed thereon. Thus, the toner image $T_Y$ ($T_M$, $T_C$) transferred to the sheet P by means of a preceding image forming means can be transferred by means of a subsequent image forming means without being separated from the sheet P. In consequence, a very satisfactory multi-color image can be formed.

The yellow, magenta, and cyan toner images $T_Y$, $T_M$ and $T_C$, tentatively fixed to the paper sheet P, can be finally fixed with stability at the same time with the black toner image $T_B$, so that a stable multi-color image can be obtained.

As mentioned before, moreover, the respective photoreceptor drums $30_Y$, $30_M$, $30_C$ and $30_B$ of the process units 5, 6, 7 and 8 are set so that their respective peripheral speeds V1, V2, V3 and V4 have the relationships given by $V4>V3>V2>V1$, that is, the speed increases downstream with respect to the paper feeding direction. Thus, the paper sheet P can be prevented from slackening due to the differences in peripheral speed between the drums, and imaging errors can be securely prevented.

As mentioned before, furthermore, the photoreceptor drums $30_Y$, $30_M$, $30_C$ and $30_B$, heated under the influence of the tentative fixing by means of the flashlight devices 20, can be kept at the fixed temperature by being compulsorily air-cooled from the inside. Thus, the properties of the drums can be prevented from changing, that is, the drums can maintain good, reliable properties.

Figure 7:
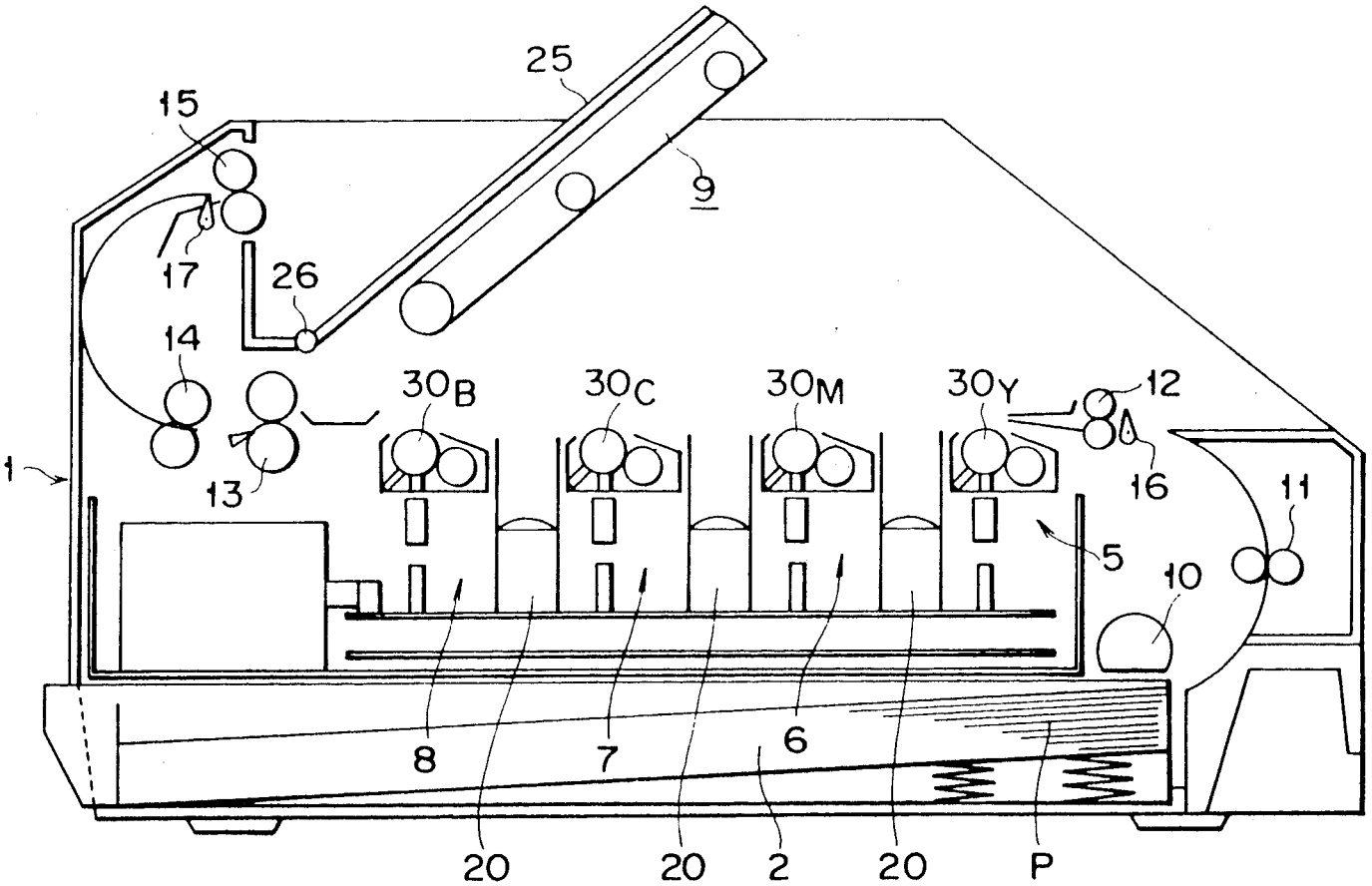
FIG. 7 is a diagram for illustrating a state in which a paper transportation path is exposed.

In case of paper jamming in the paper transportation path 4 or in replacing the process units 5 to 8, removal or replacement work can be facilitated by upwardly rocking the receiving tray 25, which doubles as the top cover of the apparatus shell 1, as shown in FIG. 7.

In the embodiment described above, the yellow, magenta, cyan, and black toner images $T_Y$, $T_M$, $T_C$ and $T_B$ are superposed to obtain a multi-color image. However, the black toner image $T_B$ is not indispensable. What is essential is that a plurality of toner images be able to be successively transferred to the same paper sheet P.

Although the flashlight devices 20 are used as the tentative fixing means in the foregoing embodiment, any, they may be replaced with any other suitable fixing means, such as a main charger, heat roller, etc.

It is to be understood that the present invention is not limited to the embodiment described above, and that various changes and modifications may be effected therein by one skilled in the art without departing from the scope or spirit of the invention.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. An image forming apparatus comprising:

first image forming means for forming a first image on a first photo receptor member;

first transfer means for transferring the first image formed by the first forming means to a transfer medium;

second image forming means for forming a second image on a second photo receptor member;

second transfer means for transferring the second image formed by the second forming means to the transfer medium;

conveying means for conveying the transfer medium to the first image forming means and then to second image forming means; and means for cooling the first and second image carrier, said cooling means having air current generating means for causing cooling air to flow along the first and second photo receptor members, thereby air-cooling the same, said air current generating means including blast means for generating a current of air, a duct disposed so that the air current generated by means of the blast means is guided to each photo receptor member through the duct, and regulating means for regulating the amount of cooling air guided to each photo receptor member through the duct.

2. The image forming apparatus according to claim 1, wherein said regulating means has opening means for regulating the opening of air passage sections.

3. The image forming apparatus according to claim 1, wherein each said photo receptor member has a hollow cylinder, and said air current generating means has a means for circulating the cooling air through a hollow portion of each photo receptor member.

4. An image forming apparatus comprising:

first image-forming means, including an image carrier, for forming a first color image on the image carrier thereof;

second image-forming means, including an image carrier, for forming a second color image on the image carrier thereof;

third image-forming means, including an image carrier, for forming a third color image on the image carrier thereof;

fourth image-forming means, including an image carrier, for forming a fourth color image on the image carrier thereof;

supply means for supplying a transfer medium onto which the first, second, third and fourth color images are transferred, respectively, from the image carriers of the first, second, third and fourth image-forming means;

conveyance means for conveying the transfer medium supplied by the supply means to the first, second, third and fourth image-forming means;

a plurality of transfer means respectively located at positions corresponding to the first, second, third and fourth image-forming means, for transferring the images from the respective image carriers to the transfer medium;

first fixing means, located between the first and second image-forming means, for fixing the first color image to the transfer medium to such a degree that separation of the first color image from the transfer medium is prevented when the second color image is subsequently transferred from the image carrier of the second image-forming means to the transfer medium;

second fixing means, located between the second and third image-forming means, for fixing the second color image to the transfer medium to such a degree that separation of the second color image from the transfer medium is prevented when the third color image is subsequently transferred from the image carrier of the third image-forming means to the transfer medium;

third fixing means, located between the third and fourth image-forming means, for fixing the third-color image to the transfer medium to such a degree that separation of the third-color image from the transfer medium is prevented when the fourth color image is subsequently transferred from the image carrier of the fourth image-forming means to the transfer medium; and fourth fixing means, located downstream of the fourth image-forming means with respect to a path of the transfer medium, for fixing the fourth color image to the transfer medium.

5. An image-forming apparatus according to claim 4, wherein said conveyance means includes an endless conveyance belt.

6. An image-forming apparatus according to claim 4, wherein said first, second and third fixing means are temporary fixing means for temporarily fixing the first, second and third color images to the transfer medium.

7. An image-forming apparatus according to claim 6, wherein each of said first, second and third fixing means includes a flash lamp, and said fourth fixing means includes a pair of rollers.

8. An image-forming apparatus according to claim 4, wherein said image carriers of the first, second, third and fourth image-forming means are rotated such that the circumferential speed of an image carrier located downstream with respect to the path of the transfer medium is higher than the circumferential speed of an image carrier located upstream with respect to the path of the transfer medium.

9. An image forming apparatus comprising:

first image forming means for forming a first image on a first photo receptor member;

first transfer means for transferring the first image formed by the first forming means to a transfer medium;

second image forming means for forming a second image on a second photo receptor member;

second transfer means for transferring the second image formed by the second forming means to the transfer medium;

conveying means for conveying he transfer medium to the first image forming means and then to second image forming means;

means, located between the first transfer means and the second transfer means, for thermally fixing the first image transferred by the first transfer means to the transfer medium so as not to separate the first image from the transfer medium when the second transfer means transfers the second image to the transfer medium; and means for cooling the first and second photo receptor members, which are heated by accumulated heat of the transfer medium due to fixing operations by means of the thermally fixing means, said cooling means being designed so that there is a relationship $D1 < D2$, wherein D1 and D2 are the amounts of cooling air for the first and second photo receptor members, respectively.

* * * * *

UNITED STATES PATENT AND TRADEMARK OFFICE

CERTIFICATE OF CORRECTION

PATENT NO. : 5,177,554

DATED : January 5, 1993

INVENTOR(S) : Goro ODA et al.

It is certified that error appears in the above-identified patent and that said Letters Patent is hereby corrected as shown below:

On the title page: Item
[75] Please change "Masuro Tokura" to --Masuo Tokura--.

Signed and Sealed this

First Day of March, 1994

Bruce Lehman

*Attest:*

BRUCE LEHMAN

*Attesting Officer*

*Commissioner of Patents and Trademarks*